United States Patent [19]

Tamura

[11] 4,106,764

[45] Aug. 15, 1978

[54] CARDBOARD-FEEDING DEVICE

[75] Inventor: Takeo Tamura, Tokyo, Japan

[73] Assignee: Tanabe Shiko Kikai Seizo Kabushiki Kaisha, Tokyo, Japan

[21] Appl. No.: 802,971

[22] Filed: Jun. 2, 1977

[30] Foreign Application Priority Data

Jun. 17, 1976 [JP] Japan ..... 51-71817

[51] Int. Cl.[2] ..... B65H 3/04

[52] U.S. Cl. ..... 271/35; 271/165

[58] Field of Search ..... 271/35, 145, 165, 126, 271/133, 160

[56] References Cited

U.S. PATENT DOCUMENTS 3,034,784 5/1962 Lopez ..... 271/35 UX 3,612,511 10/1971 Godlewski ..... 271/35

*Primary Examiner*—Richard A. Schacher

[57] ABSTRACT

A cardboard sheet-feeding device used for feeding corrugated cardboard one sheet after another, such as to an automatic box-making machine. The cardboard-feeding device has a frictional conveyor belt driven in one direction, a control plate located above the frictional conveyor belt, and a positioning device for stacking sheets of cardboard upon the frictional conveyor belt behind the control plate, whereby upon movement of the frictional conveyor belt the bottom most cardboard sheet in the stack stacked on the friction conveyor belt is fed forward, slipping under the control plate. There is also provided a cardboard-holding device which is supported and driven by a pair of endless movable loops, the loops being driven via a sliding clutch, and which exerts pressure on the stack of sheets to correct warping of the sheets regardless of the height of the stack.

8 Claims, 3 Drawing Figures

CARDBOARD-FEEDING DEVICE

This invention relates to a cardboard sheet-feeding device for feeding sheets of cardboard one after another to a device such as an automatic box-making machine.

BACKGROUND OF THE INVENTION AND PRIOR ART

As a means for feeding sheets of corrugated cardboard one sheet after another to a machine such as an automatic box-making machine, there is known a device which consists of a frictional conveyor belt driven in the one direction, a control plate located above said frictional conveyor belt and a positioning means for stacking sheets of cardboard on said frictional conveyor belt behind said control plate, whereby upon the movement of said frictional conveyor belt the bottommost sheet of cardboard in said stack is fed forward, slipping under said control plate.

In said known device, however, when a warped sheet of cardboard happens to be included in the stack or the whole stack happens to be warped, the sheet of cardboard to be fed forward will be obstructed by the control plate and, being unable to slip under said control plate, it will cause trouble with the cardboard feeding. Especially when the stack is small, the pressure acting on the bottommost sheet of cardboard will be smaller than when the stack is high. Therefore, there is little likelihood that warping of the bottommost sheet of cardboard will be corrected by the weight of the stack, and the feeding of the sheets will often be improper.

In view of this problem with the conventional device, there has been a demand for a cardboard sheet-feeding device equipped with a cardboard-holding mechanism which makes it possible to correct the warping of the sheets of cardboard irrespective of the height of the stack, thereby ensuring smooth feeding of the sheets of cardboard.

OBJECT OF THE INVENTION

The primary object of the present invention is to provide a cardboard-feeding device equipped with a pressure-holding mechanism for correcting the warping of the sheets of cardboard irrespective of the height of the stack of sheets in the feeding device.

Another object of the present invention is to provide a cardboard sheet-feeding device equipped with a pressure-holding mechanism for correcting the warping of the sheets of cardboard irrespective of the quality, format and thickness of the sheets in the stack of sheets in the feeding device.

Still another object of the present invention is to provide a cardboard sheet-feeding device equipped with a pressure-holding mechanism for automatically maintaining the sheets of cardboard in a pressure-held state in the stack of sheets in the feeding device.

Still another object of the present invention is to provide a cardboard sheet-feeding device equipped with a pressure-holding mechanism for facilitating replenishment of the sheets of cardboard in the feeding device.

BRIEF DESCRIPTION OF THE FIGURES

The cardboard-feeding device according to the present invention will be more fully understood from the following detailed description with reference to the attached drawings in which.

DETAILED DESCRIPTION OF THE INVENTION

Figure 1:
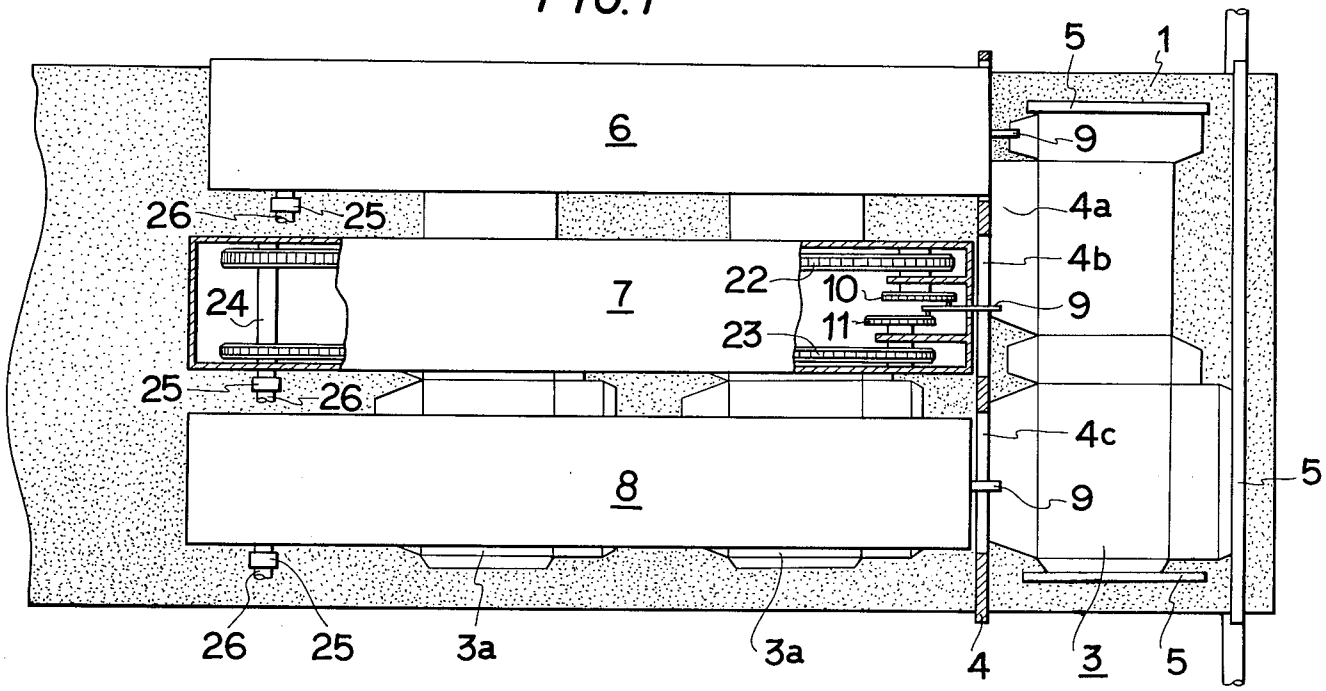
FIG. 1 is a fragmentary plan view of the device according to the invention.

In the drawings, like reference numbers denote like parts.

The cardboard sheet-feeding device has a frictional conveyor belt 1 extending in an endless loop having one end around a drive drum 2 which drives the belt 1 at a constant speed in the direction of the arrow, the upper surface of the top run of said belt being a frictional surface movable beneath a stack 3 of sheets of cardboard positioned thereon.

The stack 3 is a stack of sheets 3*a* of cardboard cut to the same size and stacked in a stack.

Stack 3 is positioned on the frictional conveyor belt 1 at a position determined by a control plate 4 and a positioning plate 5 which are spaced from each other along said conveyor belt 1. The control plate 4 and the positioning plate 5 are also spaced above the upper surface of said conveyor belt 1 so that they do not obstruct the movement of said conveyor belt 1.

The control plate 4 is located ahead of the stack 3 at right angles to the direction of travel of said conveyor belt 1; and between the bottom of the control plate 4 and the upper surface of the frictional conveyor belt 1 there is provided a clearance sufficient to permit a sheet of cardboard 3*a* to pass therethrough.

The means to support the control plate 4 and the positioning plate 5 is conventional and is not illustrated here.

The control plate 4 has openings 4*a*, 4*b* and 4*c* therein which are sufficiently wide and high for casings 6, 7 and 8 respectively to pass through.

Said casings 6, 7 and 8 house the pressure-holding mechanism to hold stack 3 by means of a holding piece 9.

Said casings 6, 7 and 8 are supported above the frictional conveyor belt 1, spaced from the upper surface of said conveyor belt sufficiently enough to allow passage of at least one sheet of cardboard 3*a* therebeneath.

Further, said casings 6, 7 and 8 are supported for movement back and forth, toward and away from the stack 3, passing through said openings 4*a*, 4*b* and 4*c* in the control plate and can be fixed at a desired position in the direction of such back and forth movement.

The means to support said casings 6, 7 and 8 is conventional and is not illustrated here.

The pressure-holding mechanisms housed in said casings 6, 7 and 8 are identical. One of these pressure-holding mechanisms will now be described.

A pair of chains 10 and 11 extend in an endless loop over sprocket wheels 12 and 13 and 14 and 15. Said sprocket wheels 12 and 13 and 14 and 15 are identical in size and are respectively fitted on the ends of shafts 16 and 17 rotatably mounted in the corresponding one of said casings 6, 7 and 8 and extending parallel to the control plate 4. The sprocket wheels are on the ends of the shafts adjacent the center of the respective casing. Thus said sprocket wheels 12, 13, 14 and 15 are at right angles to said control plate 4.

Said sprocket wheels 12 and 13 are vertically spaced and said sprocket wheels 14 and 15 are also vertically spaced, and are further spaced from the control plate 4 a distance greater than said sprocket wheels 12 and 13 are spaced in the direction of travel of the upper run of the frictional conveyor belt 1.

Between the chains 10 and 11 is fitted a cardboard-holding piece 9. The holding piece is a slender plate which toward one longitudinal end has two holes 9*a* and 9*b* extending laterally therethrough from one side to the other. At the same level on the chains 10 and 11 are inwardly extending pins 10*a* and 11*a* extending in directions toward the other and offset a distance corresponding to the spacing of the sprocket wheels 12 and 14.

The pins 10*a* and 11*a* are rotatably fitted in the holes 9*a* and 9*b* in the holding piece 9 for keeping said holding piece horizontal between the chains 10 and 11.

On the walls of said casings 6, 7 and 8 opposed to the control plate 4 are formed vertical openings 6*a*, 7*a* and 8*a* which are slightly wider than the holding piece 9. Each holding piece 9 has the tip thereof projecting through a corresponding opening 6*a*, 7*a* and 8*a* in said casings 6, 7 and 8.

At the opposite, i.e., external ends of the shafts 16 and 17 on which the sprocket wheels 12 and 14 are mounted are mounted sprocket wheels 18 and 19. Said sprocket wheels 18 and 19 are respectively coupled to sprocket wheels 20 and 21 by endless chains 22 and 23.

Said sprocket wheels 18, 19, 20 and 21 are the same size as the sprocket wheels 12, 13, 14 and 15. The sprocket wheels 20 and 21 are fixed on a shaft 24, which is coupled to a drive shaft 26 by a slippable power transmission means, here shown as a friction clutch 25 which slips when the load thereon exceeds a predetermined value. Accordingly, the sprocket wheel 12 is coupled to the drive shaft 26 by the shaft 16, the sprocket wheel 18, the chain 22, the sprocket wheel 20, the shaft 24 and the sliding clutch 25.

Rotation of the drive shaft 26 drives the sprocket wheels 12 and 14 in the direction of the arrow on wheel 14. As a result the parts of the chains 10 and 11 closer to the control plate 4 are driven down as indicated by the arrow near the bottom of chains 10 and 11 and the other runs go up, whereby the holding piece 9 moves together with said chains 10 and 11.

The operation of the device will now be described.

Figure 2:
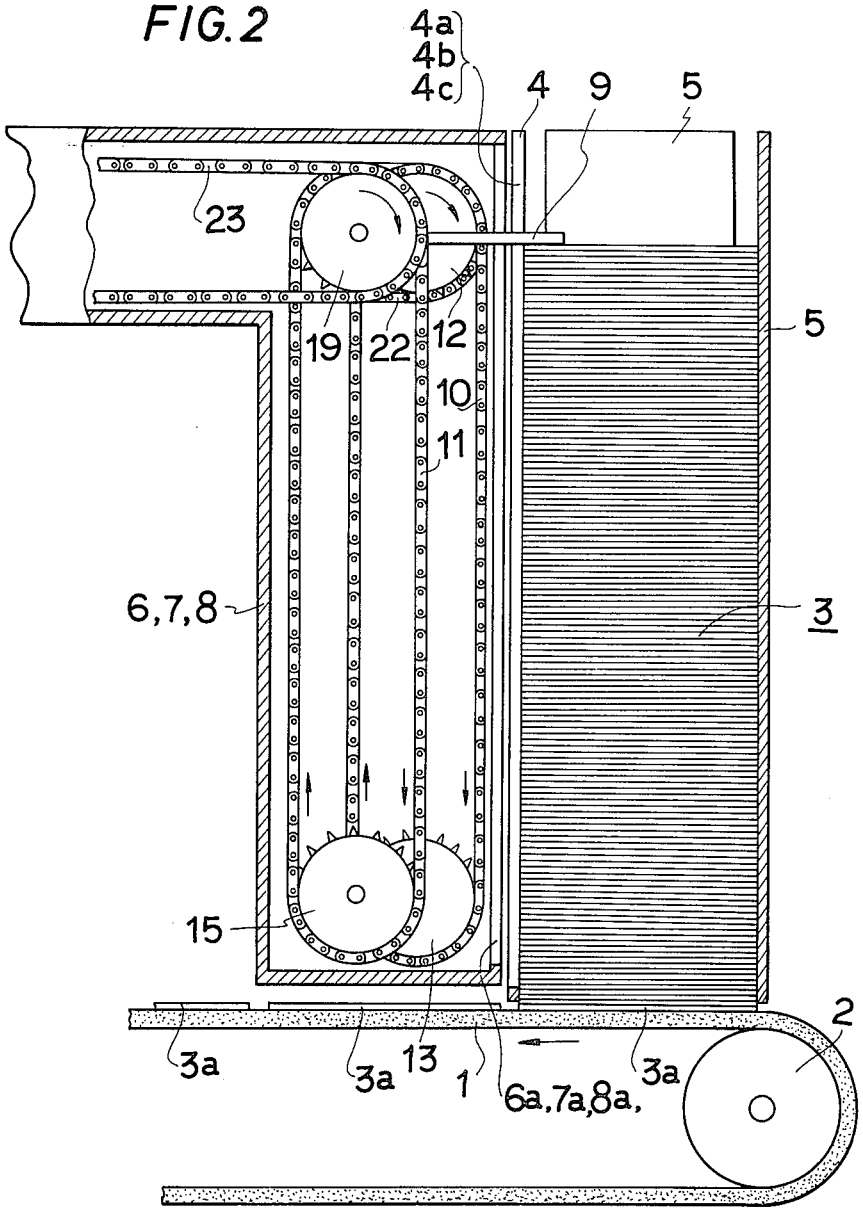
FIG. 2 is a fragmentary sectional side elevation view of the main parts of the device of the invention.
Figure 3:
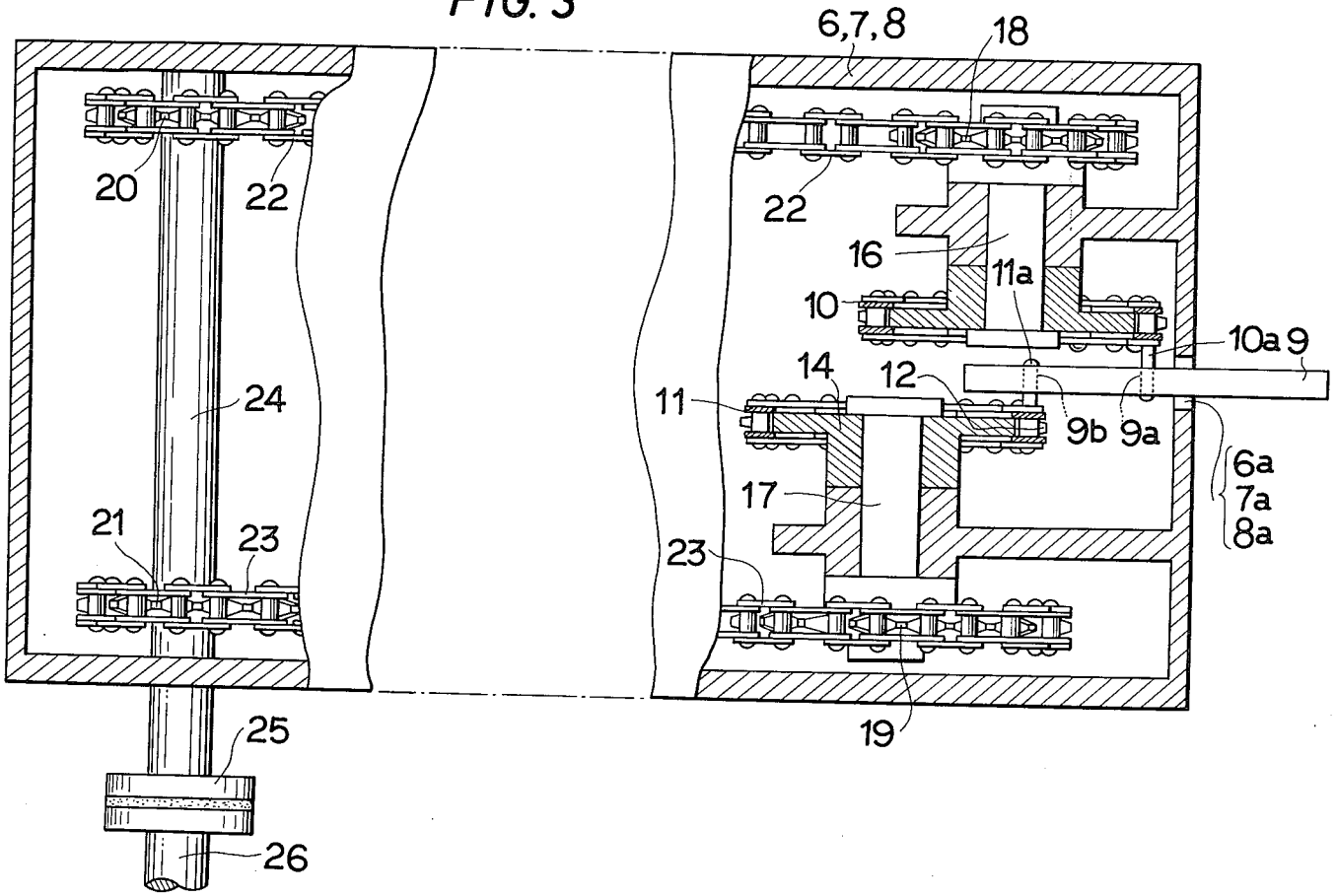
FIG. 3 is a fragmentary sectional front elevation view, on an enlarged scale, of a part of the pressure-holding mechanism of the invention.

First the action of the pressure-holding mechanism housed in the casings 6, 7 and 8 will be described. The torque of the drive shaft 26 is transmitted to the sprocket wheel 12 by the friction clutch 25, the shaft 24, the sprocket wheel 20, the chain 22, the sprocket wheel 18 and the shaft 16, and at the same time it is also transmitted to the sprocket wheel 14 by the friction clutch 25, the shaft 24, the sprocket wheel 21, the chain 23, the sprocket wheel 19 and the shaft 17. As the result, the parts of the chains 10 and 11 closer to the control plate 4 go down, while the parts farther away from the control plate 4 go up. The speeds of movement of the chains 10 and 11 are equal. Upon the movement of the chains 10 and 11, the holding piece 9, while remaining horizontal, acts as follows:

(a) the tip, projecting through the opening 6*a*, 7*a* or 8*a*, moves straight down from the position shown in FIG. 2;

(b) then the tip is withdrawn into the opening 6*a*, 7*a* or 8*a*, goes down and up in a semi-circle around the sprocket wheels 13 and 15;

(c) next, the tip, fully withdrawn into the casing 6, 7 or 8 through the opening 6*a*, 7*a* or 8*a*, moves up; and (d) thereafter, the tip extends out through the opening 6*a*, 7*a* or 8*a*, and goes up and down in a semi-circle around the sprocket wheels 12 and 14, whereupon it reaches the position shown in FIG. 2.

For the purpose of feeding the cardboard, individual sheets of cardboard 3*a* cut to the same shape are piled up into the stack 3 on the frictional conveyor belt 1. The stack 3 is located at a position bounded by the control plate 4 and the positioning plate 5.

Depending on the shape of the cardboard sheets 3*a*, the casings 6, 7 and 8 are respectively moved toward or away from plate 4 to a position where the tip of the holding piece 9 in the casing touches the top sheet in the stack 3 at the front edge of the sheet and then are fixed in the respective positions, such as shown in FIG. 1.

In FIG. 1, the casing 6 is closer to the stack 3 than the casings 7 and 8. With the tips of the holding pieces 9 on the top sheet of the stack 3 at the front edge, the frictional conveyor belt 1 is moved and the drive shaft 26 is driven. Then the stack 3 will be pressed by the tips of the holding pieces 9, while at the same time the bottommost sheet of cardboard 3*a* in the stack 3 will slip forward under the control plate 4.

The torque transmitted to the sprockets 12 and 14 through the slipping clutch 25 will maintain the pressure of the holding pieces 9 on the stack 3, and accordingly, the stack 3 will be held under a constant pressure.

As the cardboard sheets 3*a* are successively fed, the stack 3 decreases in height, and the holding pieces 9 will move downwardly, and then in a semi-circle around the sprocket wheels 13 and 15 until the tips of the pieces 9 come off the front edge of the stack 3. Thereupon, with the resistance to movement of pieces 9, previously supplied by the stack 3, being ended, the clutch 25 will cease to slip. The chains 10 and 11 will then move rapidly and the holding pieces 9 will rapidly return to the original position at the top of the chains 10 and 11.

Replenishment of cardboard sheets in the stack 3 can be carried out by placing further sheets on top of the holding pieces 9 pressing on the top of the original stack 3. After the holding pieces 9 have moved to the extreme bottom of their range of movement and rapidly returned to the top positions, the tips of the pieces 9 will press on the top sheet at the front edge of the replenished stack 3. Thus, the pressure-holding action on the stack can be automatically continued.

Through such action the bottommost sheet of cardboard 1*a* in the pressure-held stack 3 can be fed along the conveyor one sheet at a time and any warped sheet 3*a* or even a whole stack 3 of such sheets can have the shape corrected by pressure-holding.

It should be noted that the above described embodiment of the present invention is only one example thereof and of course design modifications can be made without changing the substance of the present invention.

For instance, instead of moving the casings 6, 7 and 8 closer to or farther from the stack 3, the length of the holding pieces 9 can be changed or they may be moved toward and away from the stack to accommodate the shape of the sheet of cardboard. A plurality of holding pieces 9 can be mounted on the chains 10 and 11. The area of the tip of the holding pieces 7 can be increased so that the necessary area of the cardboard stack 3 can be pressed.

In the cardboard-feeding device according to the present invention in which at least one holding piece for pressing on the top surface of the top sheet of cardboard in a stack is supported and driven by an endless movable loop moved through a friction clutch, said friction clutch slips when the holding pressure exceeds a certain value; thus with the holding pressure kept constant, the holding piece will follow the top sheet of cardboard in the stack reliably as the height of the stack decreases. Accordingly, with a constant pressure acting on it regardless of the stack height, the bottommost sheet, if warped, will be straightened.

The pressure exerted by the holding pieces can be set at any desired value by changing the force with which the parts of said friction clutch are engaged. Therefore warped sheets can be straightened regardless of the softness or thickness thereof by changing the holding pressure.

Since each holding piece is always maintained in a horizontal position by a pair of endless movable loops, there is no likelihood of the holding pressure changing in accordance with the position on the holding piece nor of the direction of the holding force deviating from the vertical direction. By changing the position or length of the holding pieces the holding can be effected regardless of the shape of the cardboard sheets and thereby the warp of the cardboard sheets can be corrected.

Each holding piece which is supported and driven by endless movable loops, after moving down to the bottommost position, will automatically be freed from the stack and move up to the topmost position where the holding begins, and can resume its holding action. Because each pair of endless movable loops is drive through the friction clutch, the clutch does not slip when the holding piece moves up after it is freed from the stack; therefore because the upward movement of the holding piece is rapid, said piece can swiftly return to the original position, resuming its holding action.

The holding pieces which automatically return to the original position after moving down to the bottommost position can support sheets of cardboard thereon to replenish the stack.

Thus the stack can be replenished by merely placing a new supply of sheets of cardboard on the holding pieces pressing on the original stack, thereby avoiding the difficulty of inserting the new supply of cardboard sheets between the holding piece and the original stack. The replenishment operation is very efficient, for it can be done without stopping the whole device.

When groups of wheels are coupled to a single shaft coupled to the drive shaft by a friction clutch, there is only one friction clutch and therefore the slipping of the drive shaft relative to each group of wheels is always constant, and it becomes extremely easy to move a pair of endless movable loops at a constant speed.

Where said wheels are sprocket wheels and said endless movable loops are endless chains, no slip occurs between the wheels and the endless loops, and consequently the holding pieces are reliably driven.

Where the holding piece is supported by pins on the endless chains, the support will be easy and reliable with no adverse effect on the function of said chains.

Thus the cardboard-feeding device according to the present invention possesses various features not found in the conventional prior art devices, and overcomes the disadvantages in the prior art devices.

What is claimed is:

1. A device for feeding flat sheets of relatively stiff material which can have warps therein, comprising:

a. a frictional conveyor belt driven in a direction for feeding the sheets;

b. a control plate mounted above said frictional conveyor belt and spaced therefrom a distance sufficient to permit passage of only one sheet at a time beneath said control plate and against which a stack of sheets is held, said plate having at least one opening extending vertically therein;

c. a positioning means mounted above the level of said conveyor and spaced from said control plate in the direction opposite the direction of movement of said conveyor for engaging the side of said stack of sheets opposite to the side engaging said control plate;

d. at least one pair of endless movable loops located on the other side of said control plate from said positioning means and at different distances therefrom and each having a vertical run adjacent and parallel to said control plate;

e. a pair of sets of wheels around which said pair of endless loops extend and for moving said endless loops at a constant speed and in a direction for moving the vertical runs downwardly along said control plate;

f. a cardboard holding piece mounted in a horizontal position between said loops and having a tip projecting through said opening in said control plate and said holding piece being movable with said loops while remaining horizontal;

g. a drive shaft for supplying torque to said sets of wheels; and h. slippable power transmission means between said sets of wheels and said drive shaft.

2. The device as claimed in claim 1 wherein there is a single shaft and each of said sets of wheels is connected to said single shaft, and said single shaft is connected to said power transmission means.

3. The device as claimed in claim 1 wherein said wheels are sprocket wheels and said endless movable loops are sprocket chains.

4. The device as claimed in claim 3 wherein said chains have pins thereon which the holding piece is rotatably supported.

5. The device as claimed in claim 1 wherein said power transmission is a friction clutch which will slip when the load thereon exceeds a predetermined value.

6. The device as claimed in claim 1 in which there is a plurality of sets of wheels and a plurality of pairs of endless movable loops and a plurality of holding pieces, the holding pieces being spaced transversely of said conveyor belt.

7. The device as claimed in claim 1 further including means for moving said holding pieces toward and away from said control plate.

8. The device as claimed in claim 7 in which said endless movable loops are mounted for movement toward and away from said control plate.

* * * * *